US009759122B2

(12) United States Patent
Aydin et al.

(10) Patent No.: US 9,759,122 B2
(45) Date of Patent: Sep. 12, 2017

(54) THERMOSTATIC VALVE FOR CONTROLLING THE TEMPERATURE OF THE COOLANT IN AN INTERNAL COMBUSTION ENGINE

(71) Applicant: BorgWarner Esslingen GmbH, Esslingen am Neckar (DE)

(72) Inventors: Ahmet Aydin, Kirchberg an der Murr (DE); Bernd Bareis, Taeferrot-Utzstetten (DE); Christof Clauss, Esslingen (DE); Marc Schneider, Wernau (DE)

(73) Assignee: BorgWarner Esslingen GmbH, Esslingen (DE)

( * ) Notice: Subject to any disclaimer, the term of this patent is extended or adjusted under 35 U.S.C. 154(b) by 100 days.

(21) Appl. No.: 14/659,416

(22) Filed: Mar. 16, 2015

(65) Prior Publication Data

US 2015/0192059 A1 Jul. 9, 2015

Related U.S. Application Data

(63) Continuation of application No. PCT/EP2013/062923, filed on Jun. 20, 2013.

(30) Foreign Application Priority Data

Sep. 17, 2012 (DE) ..... 10 2012 018 255

(51) Int. Cl.

| | |
|---|---|
| ***F01P 7/16*** | (2006.01) |
| ***F01P 11/14*** | (2006.01) |
| *F01P 7/14* | (2006.01) |

(52) U.S. Cl.

CPC ..... *F01P 7/16* (2013.01); *F01P 7/161* (2013.01); *F01P 7/167* (2013.01); *F01P 11/14* (2013.01);

(Continued)

(58) Field of Classification Search

CPC ..... F01P 7/16; F01P 2007/146; F01P 7/026; F16K 31/002; F16K 1/42; F16K 17/04;

(Continued)

(56) References Cited

U.S. PATENT DOCUMENTS 2,604,152 A * 7/1952 Denberg ..... G05D 23/027 431/55
3,898,403 A * 8/1975 Grayson ..... H01H 35/34 137/503

(Continued)

FOREIGN PATENT DOCUMENTS

CN 201437863 U 4/2010
DE 203 15 735 U1 12/2003

(Continued)

*Primary Examiner* — Hai Huynh
*Assistant Examiner* — Long T Tran
(74) *Attorney, Agent, or Firm* — Hackler Daghighian Martino & Novak

(57) ABSTRACT

A thermostatic valve for controlling the temperature of the coolant in an internal combustion engine controls the flow of coolant between the internal combustion engine and a heat exchanger. The valve includes an actuation element which functions in a temperature-dependent manner for actuating lift of a main valve and of a bypass valve in a valve housing. The actuation element has a stationary piston supported on a valve housing part. A housing can be displaced relative to the piston and on which the valve members of the main valve and of the bypass valve are arranged. Further provided is a monitoring device for the position of the main valve, which works in a contactless manner and which has at least one sensor element contained in the valve housing part, and at least one associated permanent magnet for generating a magnetic field to which the sensor element is exposed.

20 Claims, 3 Drawing Sheets

(52) U.S. Cl.
CPC ... *F01P 2007/146* (2013.01); *Y10T 137/6606* (2015.04); *Y10T 137/87338* (2015.04)

(58) Field of Classification Search
CPC ..... F16K 17/30; F16K 1/302; F16K 27/029; F16K 31/02
USPC ..... 123/41.09, 41.08, 41.58, 41.85, 188.1, 123/188.9, 188.17; 137/334, 339, 341
See application file for complete search history.

(56) References Cited

U.S. PATENT DOCUMENTS 4,287,909 A * 9/1981 Tompson ..... F23N 1/002 137/312
4,583,374 A * 4/1986 Franz ..... F25B 5/00 251/30.01
5,676,308 A * 10/1997 Saur ..... F01P 7/167 236/34.5
6,460,567 B1 * 10/2002 Hansen, III ..... F16K 31/04 137/554
6,659,050 B1 * 12/2003 Creech ..... F01P 7/167 123/41.08
6,920,846 B2 * 7/2005 Pawellek ..... F01P 5/10 123/41.44
7,170,278 B2 1/2007 Woehner
7,511,475 B2 3/2009 Maerky et al.
7,730,855 B2 * 6/2010 Lemberger ..... F01P 7/167 123/142.5 E
7,789,049 B2 * 9/2010 Duley ..... F01P 5/12 123/41.44
2002/0070367 A1 * 6/2002 Friesenhahn ..... F01P 7/167 251/11
2010/0212746 A1 * 8/2010 Maercovich ..... E03C 1/057 137/1
2012/0091212 A1 4/2012 Guilhamat et al.
2012/0240878 A1 9/2012 Haegele et al.

FOREIGN PATENT DOCUMENTS

DE 10 2007 007087 A1 8/2008
DE 10 2007 011 673 A1 9/2008
DE 10 2011 001 426 A1 9/2012

* cited by examiner

THERMOSTATIC VALVE FOR CONTROLLING THE TEMPERATURE OF THE COOLANT IN AN INTERNAL COMBUSTION ENGINE

CROSS-REFERENCE TO RELATED APPLICATIONS

This continuation application claims priority to PCT/EP2013/062923 filed on Jun. 20, 2013 which was published as WO 2014/040767 A1 and also the German application number 10 2012 018 255.4 filed on Sep. 17, 2012, the contents of which are fully incorporated herein with these references.

FIELD OF THE INVENTION

The invention relates to a thermostatic valve for controlling the temperature of the coolant of an internal combustion engine, in particular in a motor vehicle engine, which controls the flow of coolant between the internal combustion engine and a heat exchanger, in particular cooler, and/or a bypass, comprising an actuation element functioning in a temperature-dependent manner for actuating a lift of a main valve and of a bypass valve in a valve housing, wherein the actuation element has a stationary piston supported on a valve housing part and a housing which is displaceable relative to the piston and on which the valve members of the main valve and of the bypass valve are arranged.

BACKGROUND OF THE INVENTION

The cooling system of modern internal combustion engines plays a crucial role with regard to the pollutant emission and the fuel consumption. The warm-up of an engine can for example be distinctly shortened by switching off the circulation of the coolant flow through the engine block. Thereby, the friction losses are reduced, the fuel consumption reduces, the exhaust gas catalysts reach their operating temperature earlier and therefore start their function earlier. A favorable solution, in order to prevent the flow through the engine in the cold state and to control the coolant temperature actively in an engine at operating state temperature consists in the construction of a thermostatic valve with electric heating and switch-off function. Such thermostatic valves operate today with great reliability. Nevertheless, the requirement arises for a monitoring of the functional capability of the thermostatic valve.

It may be one of many objects of the present invention to configure a thermostatic valve of the type named in the introduction so that its function is monitored in a simple manner, at least with respect to establishing whether the opened or closed valve position of the main valve is present.

SUMMARY OF THE INVENTION

A thermostatic valve of the type named in the introduction according to the invention comprises a monitoring device for the position of the main valve is provided, which works in a contactless manner and which has at least one sensor element contained in the valve housing part and at least one associated permanent magnet for generating a magnetic field to which the sensor element is exposed. The sensor element connected to an evaluation device, e.g. a motor control unit. The motor control unit can therefore detect the closed position of the main valve or respectively an opening position in case of a signal change. The at least one sensor element being arranged fixed to the housing, measures the field strength of the magnetic field of the magnet as a function of the lift of the main valve and delivers an analogue or digital signal as a function of the distance of the permanent magnet, and hence of the valve member of the main valve, from the at least one sensor element.

In an embodiment, the permanent magnet is constructed in a ring shaped manner. It is preferably magnetized in an axial direction being approximately parallel to the axial direction of movement of the housing of the actuation element. The permanent magnet may be arranged directly on a face side of the housing of the actuation element, in particular is received there in an annular groove and fastened therein, e.g. by gluing or such similar means. The permanent magnet may be received in a holder which is placed onto a head part of the housing of the actuation element and is securely fixed therewith.

The at least one sensor element is expediently arranged in an adjacent manner lying axially opposite the permanent magnet. The at least one sensor element can have suppression components, e.g. capacities, adjacent thereto, which are arranged in the valve housing part. The at least one sensor element may be formed by a Hall sensor.

A further embodiment makes provision that the valve housing part has a holding part which is formed from a ready to mount injection-molded semi-finished part of plastic. This may lead to advantages in the production and assembly (but which are not necessary).

In an embodiment, one end of the piston of the actuation element can be contained in the holding part and can be insert-overmolded with the plastic material of the holding part, so that in this way the piston is a fixed part of the holding part. In the case of an electric heating device contained in the interior of the piston, to which then an electric feed line of the heating device and plug contacts connected therewith belong, the feed line and the plug contacts as parts of the piston can also be insert-overmolded with the plastic material of the holding part together with the piston. In this case, the holding part itself can also be formed and shaped when the piston with its end and with the electric feed line and the plug contacts are held in an injection mold and are insert-overmolded with plastic material simultaneously shaping the holding part.

The at least one sensor element and if applicable suppression components for this and the plug contacts thereof can be combined into one structural unit, e.g. by means of a lead frame defining and holding these. Such a structural unit can then be mounted in the holding part and cast around with its plastic material. Or, in an embodiment, this structural unit of sensor element and suppression components and plug contacts thereof together with the piston, the electric feed line and the plug contacts thereof can be united into one component in an injection mold by insert-overmolding, wherein the holding part containing these parts is also formed by plastic injection molding. Then, as a ready to mount structural unit, such a structural unit is present which consists of the holding part with piston, electric feed line and plug contacts for the heating device and of the at least one sensor element with suppression components and plug contacts thereof.

A further embodiment makes provision that the valve housing part has a plug, constructed as a hollow body, with a flange at one end, in which the plug contacts of the electric heating device and/or of the structural unit of sensor element and suppression components are inserted and held.

A further embodiment makes provision that the holding part and/or plug form a pre-mounted assembly, which is inserted into the valve housing and is insert-overmolded with the plastic material of the valve housing.

The thermostatic valve configured in such a way constitutes, with the pre-mounted assemblies, a system which is particularly constructed in a modular, compact and cost-efficient manner. The plastic material, with which the assemblies are insert-overmolded, may consist of a material (e.g. PPS-PBT), which is tight with respect to the coolant and/or does not soak-up any coolant, so that it is ensured that the electronic components are reliably protected from moisture. The thermostatic valve offers the possibility of a simple detection of a malfunction with monitoring e.g. of the closed position of the main valve.

BRIEF DESCRIPTION OF THE DRAWINGS

Further details and possible advantages of the invention will become apparent from the following description. The invention is explained in further detail below with the aid of an embodiment shown in the drawings.

DETAILED DESCRIPTION OF THE PREFERRED EMBODIMENTS

Figure 1:
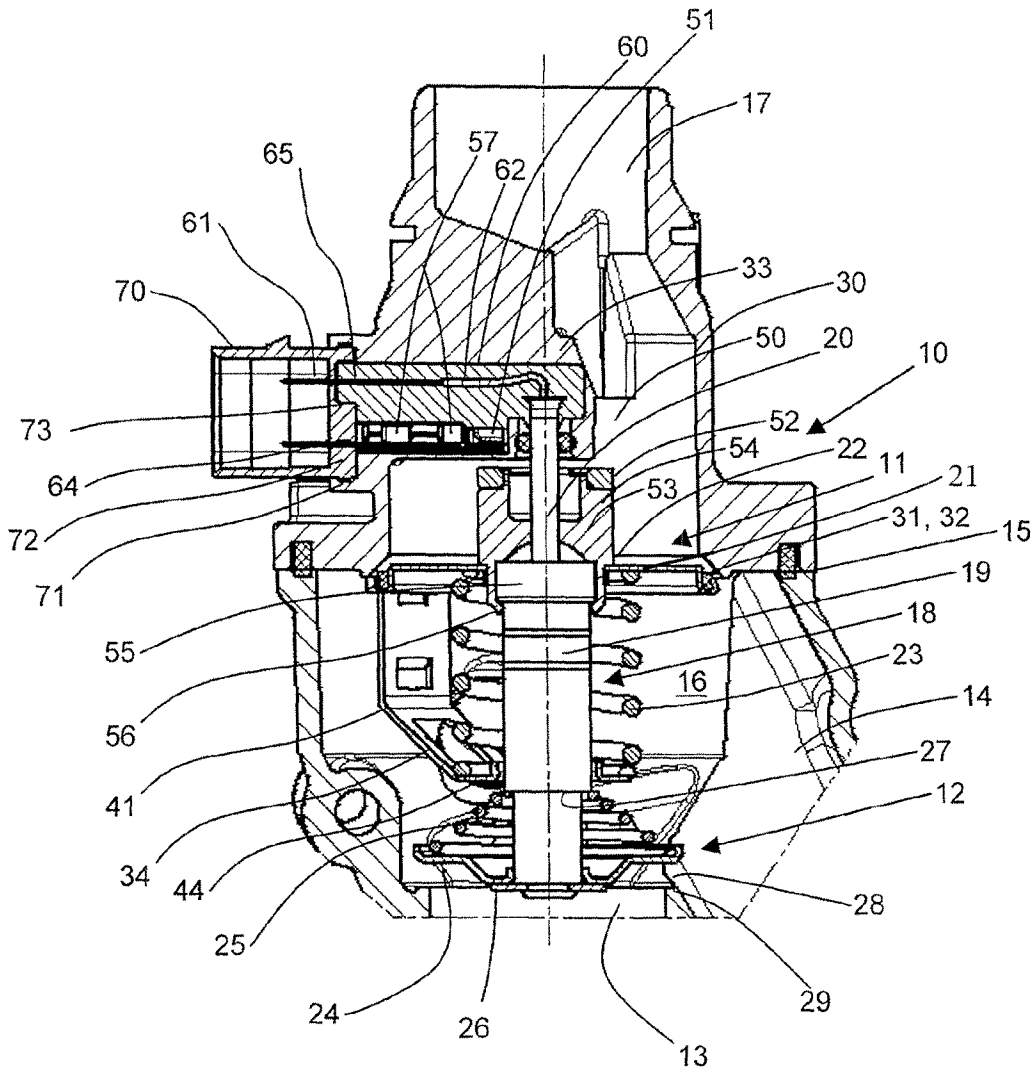
FIG. 1 shows a diagrammatic section with partial lateral view of a thermostatic valve.

In FIG. 1 a thermostatic valve 10 is shown, which serves for controlling the temperature of the coolant of an internal combustion engine, in particular in a motor vehicle engine. The thermostatic valve 10 has a main valve 11 and a bypass valve 12. The thermostatic valve 10 controls the flow of coolant from the internal combustion engine through a bypass 13 and/or through a heat exchanger (not shown), in particular a cooler, back to the internal combustion engine. With a closed main valve 11 according to FIG. 1, the coolant arrives via an opening 14 of a valve housing 15, containing the thermostatic valve 10, into its interior 16, which the coolant leaves through the bypass 13 owing to the opened bypass valve 12. If, on the other hand, the main valve 11 is open, the coolant arrives out from the interior 16 through the duct 17 to a heat exchanger (not shown).

The thermostatic valve 10 has an actuation element 18 functioning in a temperature-dependent manner, which contains in a housing 19 an expanding material which expands on heating and moves a coaxial piston 20 relative to the housing 19. On the housing 19, a valve member 21 of the main valve 11 is held, which consists here of a valve plate, but alternatively can also consist e.g. of a valve slide or other comparable structure or valve member structure. The valve member 21 lies axially on an annular flange 22 of the housing 19 and, on heating, is moved by the housing 19 against the action of a return spring 23 in FIG. 1 downwards in opening direction.

On the housing 19, in addition at the lower end region in FIG. 1, a second valve member 24 is held in an axially displaceable manner, which is part of the bypass valve 12 and is constructed e.g. as a valve plate. The valve member 24 is pressed by means of a spring 25 against a lower stop 26 on the housing 19 and is axially displaceable relative to the housing 19. The spring 25 is axially supported by its upper end on an annular flange 27 of the housing 19. Associated with the valve member 24 is a face-side valve seat surface 28, which runs beneath the valve member 24 and is formed e.g. by the upper face surface of a coaxial cylindrical section 29, which can be part of the valve housing 15.

An approximately tubular component 30 is arranged detachably, but securely and in a tight manner, on the valve housing 15, which component contains the valve seat 31 being associated with the first valve member 21 of the main valve 11 and having the form of an inner surface 32 approximately in the form of a frustum of a cone. The component 30 can consist of plastic or metal, e.g. aluminum. It contains in the interior the duct 17 and, in addition, a valve housing component 33, on which the piston 20 is supported axially by its upper end.

The return spring 23 associated with the valve member 21 and the housing 19 is axially supported by the upper end in FIG. 1 on the valve member 21 and by its lower end in FIG. 1 on a support device 34. The support device 34 has arms 41 held on the component 30, bracing downwards from there in FIG. 1, having end-sided, inwardly directed projections 44, which form a support surface for the end of the return spring 23.

The upper component 30 is placed onto the lower part of the valve housing 15, with interposition of a seal 35, and is fastened thereon.

In order to be able to establish whether the functional capability of the thermostatic valve 10 according to FIG. 1 exists, or, owing to a defect e.g. in the open or closed position, does not exist, a monitoring device 50 which works in a contactless manner is provided for the position of the main valve 11, which has at least one sensor element 51, which is contained in the valve housing part 33, and at least one associated permanent magnet 52 for generating a magnetic field to which the sensor element 51 is exposed. This monitoring device 50 serves at least for detecting the open and/or closed position of the main valve 11 and is connected to an evaluation device (not shown), e.g. engine control unit, by means of which a corresponding signal is generated on an error-functional remaining in the closed or in the open position.

The permanent magnet 52 is ring-shaped and is fastened on the face side on an approximately cup-shaped holder 53, e.g. in an annular grove 54. The holder 53 is placed onto a head part 55 of the housing 19 of the actuation element 18 and is securely connected therewith, e.g. by flanging of a flanged rim 56. In another example embodiment, which is not shown, the permanent magnet 52 may be arranged directly in the face side of the housing, e.g. in an annular groove there. The permanent magnet 52 is magnetized in an axial direction being approximately parallel to the axial direction of movement of the housing 19 of the actuation element 18. The at least one sensor element 51 is arranged in an adjacent manner lying axially opposite the permanent magnet 52 in the valve housing part 33. Associated with the at least one sensor element 51 are suppression components 57, e.g. capacitors, adjacent thereto, which are likewise contained in the valve housing part 33.

The at least one sensor element 51 consists of a magnet sensor, in particular of a Hall sensor. The sensor element 51 is arranged fixedly in relation to the housing 19 of the actuation element 18. The permanent magnet 52 generates a magnetic field in the region of the sensor element 11, the field strength of which is measured by the sensor element 51 as a function of the lift of the housing 19. Via the field strength of the magnetic field of the permanent magnet 52, the distance of the permanent magnet 52 and hence of the housing 19 with valve member 21 is measured by means of the sensor element and accordingly an analogue or digital signal is emitted to the evaluation unit (not shown), in particular an engine control unit. Therefore, in this way, the engine control unit can establish the position "closed" or "open" of the main valve 11 on a change of signal.

Figure 2:
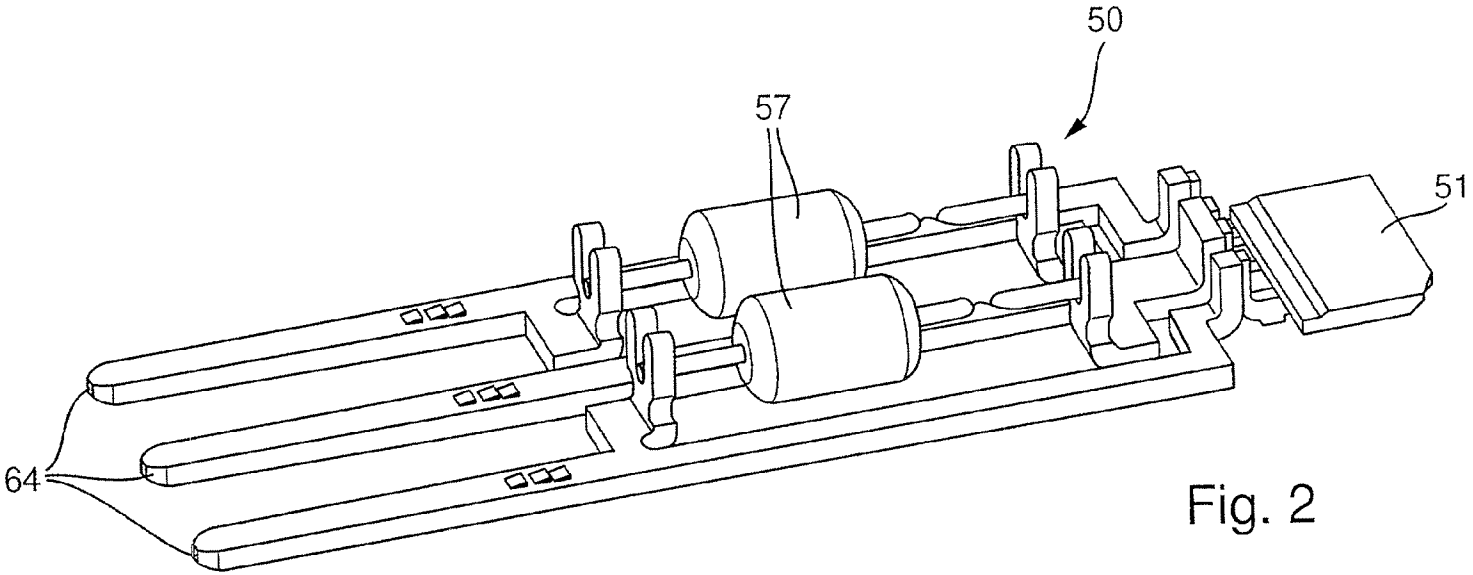
FIG. 2 shows a diagrammatic perspective view of a detail of the thermostatic valve of FIG. 1 before assembly.
Figure 3:
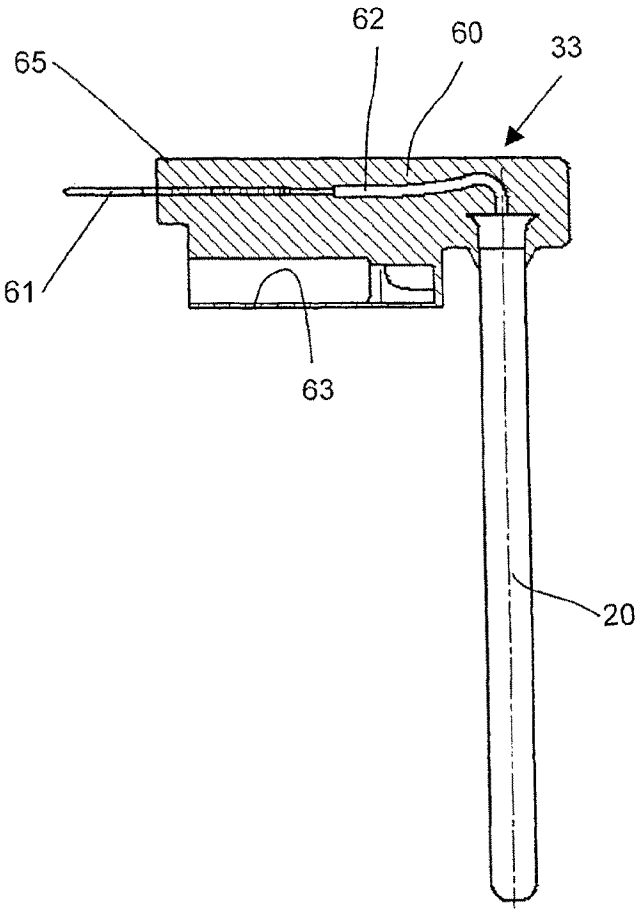
FIG. 3 shows a diagrammatic section of a holding part of the thermostatic valve before assembly.
Figure 4:
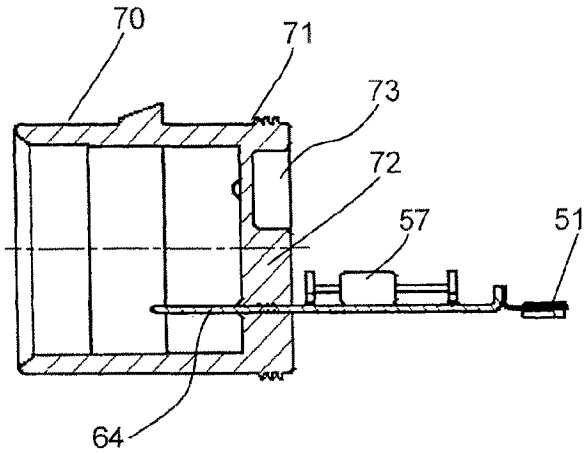
FIG. 4 shows a diagrammatic section of a plug with a structural unit of sensor element and suppression components of the thermostatic valve before assembly.

In FIG. 3 it is shown that the valve housing part 33 has a holding part 60, which is formed from a ready to mount injection-molded semifinished part of plastic. One end of the piston 20 of the actuation element 18 is contained in this holding part 60. In the illustrated embodiment, an electric heating device (not shown) is arranged in the interior of the piston 20, which heating device can be energized via two plug contacts 61 with electric feed line 62. In addition to the upper end of the piston 20, the electric feed line 62 and the plug contacts 61 are contained in the holding part 60 and are insert-overmolded with the plastic material of this holding part 60 or e.g. are injection-molded in a single injection process with formation of the holding part 60, so that in this respect a ready to mount injection-molded part is already present. Beneath the course of the plug contacts 61 and feed line 62 the holding part 60 contains a pocket 63. The at least one sensor element 51 and applicable necessary suppression components 57 for the latter and three plug contacts 64 thereof are combined to form a structural unit shown in FIG. 2, wherein the plug contacts 64 are formed by a correspondingly configured lead frame, which carries the suppression components 57 and, on which in addition the at least one sensor element 51 is mounted on the end side. In this combination, the structural unit shown in FIG. 2 is produced. On assembly, this structural unit according to FIG. 2 can be introduced into the pocket 63 of the holding part 60 and can be cast with the plastic material of the holding part 60. Instead of this, the lead frame with the plug contacts 64, the suppression components 57 and the sensor element 51 together with the piston 20, the feed lines 62 and the plug contacts 61 can be united to form a component by injection-molding in an injection mold together with forming of the holding part 60. The plastic material of the holding part 60 preferably consists of a material, e.g. PPS or PBT, which is tight with respect to the coolant passing through the thermostatic valve 10 and/or does not soak-up any coolant. It is thereby ensured that the electronic components are reliably protected from moisture.

The valve housing part 33 has, in addition to the holding part 60, a plug 70 constructed as a hollow body, with a collar 71 at the end, which is closed by means of a base 72. The collar 71 is formed from circumferential radially protruding projections. The base 72 is penetrated by the two plug contacts 61 for the piston 20 and the plug contacts 64 of the structural unit in FIG. 2, which project into the interior of the plug 70. These plug contacts 61 and 64 are inserted into the base 72 and held therein. The holding part 60 and the plug 70 can again form an assembly which is pre-assembled or completely insert-overmolded in a mold, wherein a projecting part 65 being present at the holding part 60 in FIG. 3 engages into a corresponding depression 73 in the base 72 of the plug 70. Such a structural unit of holding part 60 and plug 70 can then be inserted easily, e.g. from the left side in FIG. 10, into the valve housing, and namely into a cavity 36 provided for receiving in the component 30, and can be insert-overmolded with the plastic material of the valve housing 15, in particular of its component 30.

The described thermostatic valve 10 offers a monitoring, working in a contactless manner, of the valve lift of the main valve 11 and an establishing whether the open or closed position has been reached owing to a control play of the main valve, or whether an operational disturbance is present, in which the thermostatic valve 10 remains or jams in the open or closed position. The system is constructed in a modular, compact and cost-efficient manner. It is able to be used almost in all thermostat housings made of plastic. Described thermostatic valves 10 are able to be used for utility vehicle engines or also for high-performance passenger car engines. The production and in particular the assembly is simple and cost-efficient. Owing to the casting and insert-overmolding of the electronic components and further elements, a reliable sealing with respect to the coolant conducted in the thermostatic valve 10 is achieved, and a protection from moisture exists permanently.

What is claimed is:

1. A thermostatic valve for controlling the temperature of a coolant of an internal combustion engine, the thermostatic valve controlling the flow of the coolant between the internal combustion engine and a heat exchanger and/or a bypass, the thermostatic valve comprising:

an actuation element functioning in a temperature-dependent manner actuating a movement of a main valve and of a bypass valve in a valve housing;

wherein the actuation element includes a stationary piston supported on a valve housing part;

wherein a housing is displaceable relative to the stationary piston and on which the valve members of the main valve and bypass valve are arranged;

wherein a monitoring device for the position of the main valve, which works in a contactless manner, has at least one sensor element contained in the valve housing part and at least one associated permanent magnet attached to the housing for generating a magnetic field to which the sensor element is exposed.

2. The thermostatic valve according to claim 1, wherein the permanent magnet is constructed in a ring shaped manner.

3. The thermostatic valve according to claim 1, wherein the permanent magnet is arranged on a face side of the housing of the actuation element.

4. The thermostatic valve according to claim 1, wherein the permanent magnet is magnetized in an axial direction being approximately parallel to the axial direction of movement of the housing of the actuation element.

5. The thermostatic valve according to claim 1, wherein the sensor element is arranged in an adjacent manner lying axially opposite the permanent magnet.

6. The thermostatic valve according to claim 1, wherein the at least one sensor element has suppression components adjacent thereto, which are arranged in the valve housing part.

7. The thermostatic valve according to claim 1, wherein the at least one sensor element is formed by a Hall sensor.

8. The thermostatic valve according to claim 1, wherein the valve housing part has a holding part, which is formed from a ready to mount injection-molded semi-finished part of plastic.

9. The thermostatic valve according to claim 8, wherein an electric heating device is contained in the interior of the stationary piston, wherein in the holding part one end of the stationary piston and an electric feed line of the electric heating device and plug contacts connected therewith are contained and are insert-overmolded with the plastic material of the holding part.

10. The thermostatic valve according to claim 9, wherein the at least one sensor element and the plug contacts thereof are combined to form a structural unit and are either mounted in the holding part or cast with its plastic material.

11. The thermostatic valve according to claim 9, wherein the at least one sensor element and the plug contacts thereof with the piston with feed line and plug contacts are united into one component by insert-overmolding together with forming of the holding part containing these parts.

12. The thermostatic valve according to claim 9, wherein the valve housing part has a plug constructed as a hollow body with a collar at one end, in which the plug contacts of the electric heating device and/or of the structural unit of sensor element and suppression components are inserted and held.

13. The thermostatic valve according to claim 12, wherein the holding part and/or the plug form a pre-mounted assembly, which is inserted into the valve housing and is insert-overmolded with the plastic material of the valve housing.

14. A thermostatic valve, comprising:

a valve body having an inlet in fluidic communication with a main outlet and a bypass outlet;

a stationary piston disposed inside the valve body, wherein one end of the stationary piston is attached to the valve body;

a housing moveably attached to the stationary piston, where the housing is displaceable relative to the stationary piston in a temperature-dependent manner;

a main valve attached to the housing, wherein a displaceable movement of the housing either opens or closes the main valve in relation to opening or closing fluidic communication between the inlet and main outlet;

a bypass valve attached to the housing, wherein the displaceable movement of the housing either opens or closes the bypass valve in relation to opening or closing fluidic communication between the inlet and the bypass outlet;

a permanent magnet attached to the housing;

a sensor attached within and to the valve body, wherein the sensor is disposed in close proximity to the permanent magnet; and wherein the permanent magnet generates a magnetic field which is detectable by the sensor, where the sensor can detect a position of the housing within the valve body.

15. The thermostatic valve according to claim 14, including an electric heating device contained in an interior of the stationary piston.

16. The thermostatic valve according to claim 15, including an electric feed line connected at one end to the electric heating device and connected at the other end to a plug contact.

17. The thermostatic valve according to claim 15, wherein the permanent magnet is magnetized in an axial direction being approximately parallel to the axial direction of movement of the housing of the actuation element.

18. A thermostatic valve for controlling the flow of a coolant of an internal combustion engine, the thermostatic valve comprising:

a valve body having an inlet in fluidic communication with a main outlet and a bypass outlet;

a stationary piston disposed inside the valve body, wherein one end of the stationary piston is attached to the valve body;

a housing moveably attached to the stationary piston, where the housing is displaceable relative to the stationary piston in a temperature-dependent manner;

a main valve attached to the housing, wherein a displaceable movement of the housing either opens or closes the main valve in relation to opening or closing fluidic communication between the inlet and main outlet;

a bypass valve attached to the housing, wherein the displaceable movement of the housing either opens or closes the bypass valve in relation to opening or closing fluidic communication between the inlet and the bypass outlet;

a permanent magnet attached to the housing;

a sensor attached within and to the valve body, wherein the sensor is disposed in close proximity to the permanent magnet, and wherein the sensor is connected to a first plug contact;

wherein the permanent magnet generates a magnetic field which is detectable by the sensor, wherein the sensor can detect a position of the housing within the valve body, and an electric heating device contained in an interior of the stationary piston, wherein the electric heating device is connected to an electric feed line which is connected to a second plug contact.

19. The thermostatic valve according to claim 18, wherein the first plug contact and second plug contact are attached to the valve body parallel and adjacent to one another.

20. The thermostatic valve according to claim 19, wherein the sensor comprises a Hall sensor.

* * * * *